US006202936B1

(12) United States Patent
Frick

(10) Patent No.: US 6,202,936 B1
(45) **Date of Patent: *Mar. 20, 2001**

(54) FUEL INJECTOR HAVING A FLAT DISK SWIRL GENERATOR

(75) Inventor: Michael J. Frick, Yorktown, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/472,902

(22) Filed: Dec. 28, 1999

(51) Int. Cl.[7] ..... F02D 1/06; F02D 7/00

(52) U.S. Cl. ..... 239/5; 239/463; 239/533.12; 239/585.1; 239/596; 251/129.15

(58) Field of Search ..... 239/585.1–585.5, 239/533.12, 596, 494, 496, 463, 497, 472, 473, 5; 251/129.21, 129.18, 129.15

(56) References Cited

U.S. PATENT DOCUMENTS

| | | | | |
|---|---|---|---|---|
| 2,273,830 | | 2/1942 | Brierly et al. | 29/157 |
| 4,040,396 | * | 8/1977 | Tomita | 239/533.12 |
| 4,120,456 | | 10/1978 | Kimura et al. | 239/464 |
| 4,643,359 | | 2/1987 | Casey | 239/585 |
| 5,114,077 | | 5/1992 | Cerny | 239/483 |
| 5,207,384 | | 5/1993 | Horsting | 239/463 |
| 5,271,563 | | 12/1993 | Cerny | 239/533.2 |
| 5,409,169 | | 4/1995 | Saikalis et al. | 239/404 |
| 5,462,231 | | 10/1995 | Hall | 239/585.4 |
| 5,494,224 | | 2/1996 | Hall et al. | 239/585.5 |
| 5,625,946 | | 5/1997 | Wildeson et al. | 29/888.41 |
| 5,630,400 | | 5/1997 | Sumida et al. | 123/470 |
| 5,636,796 | | 6/1997 | Oguma | 239/533.12 |
| 5,871,157 | | 2/1999 | Fukutomi et al. | 239/463 |
| 5,875,972 | | 3/1999 | Ren et al. | 239/463 |
| 6,039,272 | * | 3/2000 | Ren et al. | 239/597 |

FOREIGN PATENT DOCUMENTS

| | | |
|---|---|---|
| WO 09910649 A1 | 3/1999 | (DE) . |
| WO 99/10648 | 3/1999 | (DE) . |
| WO 9910649 | 3/1999 | (DE) . |
| 2 140 626 | 4/1984 | (GB) . |
| 0241973 | 9/1990 | (JP) . |

OTHER PUBLICATIONS

*Geometrical Effects on Flow Characteristics of Gasoline High Pressure Direct Injecter*, W.M. Ren, J. Shen, J.F. Nally Jr., p. 1–7, (97FL–95), (No Date).

* cited by examiner

*Primary Examiner*—Lisa Ann Douglas

(57) ABSTRACT

A fuel injector having a body, an armature, a needle, a seat, and a flat disk that provides both a needle guide and a swirl generator. The body has an inlet portion, an outlet portion, and an axially extending body passage from the inlet portion to the outlet portion. An armature proximate the inlet portion of the body. A needle is operatively connected to the armature. A seat is located proximate the outlet portion of the valve body. The seat includes a first seat surface, a second seat surface, a seat passage extending between the first seat surface and the second seat surface in the direction of the longitudinal axis. The flat disk is located proximate the first seat surface. The flat disk has a first disk surface and a second disk surface. A guide aperture and at least one opening extends between the first disk surface and the second disk surface, and a swirl generator is provided in the second disk surface that communicates with the guide aperture.

17 Claims, 2 Drawing Sheets

FUEL INJECTOR HAVING A FLAT DISK SWIRL GENERATOR

FIELD OF INVENTION

This invention relates to fuel injectors in general and particularly high-pressure, direct-injection fuel injectors. More particularly, high-pressure, direct-injection fuel injectors having a swirl generator within the body of the fuel injector.

BACKGROUND OF THE INVENTION

It is known in the art relating to high-pressure direct injection fuel injectors to have a swirl generator and needle guide positioned proximate a seat in a body. In known systems, seat, swirl generator, and needle guide combinations include a plurality of structural members. For example, commonly assigned U.S. Pat. No. 5,875,972 discloses two separate flat disks adjacent a seat to provide a swirl generator and a needle guide. The flat disks are thin sheet metal members that are believed to produce minimal drag on the needle of the fuel injector. To assemble this arrangement of the seat, swirl generator, and needle guide seat combination requires each of the three components to be sequentially aligned and laser welded together. Due to the numerous individual assembly steps required, misalignments could occur with the multiple components.

Another manufacturing difficulty that could result from the three components used to form the seat, swirl generator, and needle guide combination is the need to develop new assembly steps for changes in the swirl disk configuration. The three component combination employs an individual flat swirl disk, between a flat guide disk and a seat as the swirl generator. Changes in swirl disk thickness size due to varying fuel swirl requirements for selected direct fuel injection applications requires the assembly steps to be reconfigured. A known two component seat, swirl generator, and needle guide combination, described above has been developed that addresses some of the assembly difficulties of the three component combination. Although some of the assembly difficulties the three component combination may have been overcome, the two components must be oriented during assembly. In addition, the swirl generator and needle guide component employed in known two component combination is believed to create a large drag point for the employed needle. Thus, there is a need for a two component seat, swirl generator, and needle guide combination that eliminates the need to orient the components and minimizes drag forces applied to the needle valve.

SUMMARY OF THE INVENTION

The present invention provides the fuel injector having a body, an armature, a needle, a seat, a flat disk that provides a needle guide and a swirl generator. The body has an inlet portion, an outlet portion and a body passage extending from the inlet portion to the outlet portion along a longitudinal axis. The armature proximate the inlet portion of the body. The needle valve is operatively connected to the armature. The seat is located proximate the outlet portion of the body. The valve seat includes a first seat surface, a second seat surface, a seat passage extending between the first seat surface and the second seat surface in the direction of the longitudinal axis. The flat disk is located proximate the first surface of the seat. The flat disk includes a first disk surface, a second disk surface, a guide aperture extending between the first disk surface and the second disk surface. At least one fuel passage opening extends between the first disk surface and the second disk surface. The flat disk includes a swirl generator formed in the second disk surface that communicates with the at least one fuel opening and the passage of the seat.

In a preferred embodiment, the swirl generator has at least one channel that extends from the at least one fuel passage opening toward the guide aperture. The at least one channel extends substantial tangent to a periphery of the guide passage. The at least one channel comprises a plurality of channels uniformly disposed about the guide aperture. The at least one fuel passage comprises a plurality of fuel passages disposed about axis of the guide aperture. The flat disk has a substantially circular circumferential surface engaging the first seat surface and the second seat surface; and the plurality of fuel passages are located between the axis of the guide aperture and the circumferential surface of the flat disk. The at least one channel has a plurality of channels. One of the plurality of channel corresponds to one of the plurality of fuel passage opening and the guide aperture.

The present invention also provides a flat disk for a fuel injector. The flat disk provides a guide for a needle of the fuel injector and an arrangement to swirl fuel on a seat. The flat disk has a first disk surface, an outer circumference engaging the first disk surface, and a second disk surface engaging the outer circumference. A guide aperture extends between the first disk surface and the second disk surface. The guide aperture has a central axis. A plurality of fuel passages extend between the first disk surface and the second disk surface. A swirl generator formed in the second disk surface that communicates with the guide aperture.

In a preferred embodiment, the swirl generator has a plurality of channels. Each of the plurality of channels corresponds to one of the plurality of fuel passage openings. Each of the plural of channels is substantial tangent to a periphery of the guide aperture, and is laser machined in the second disk surface.

The present invention further provides a method of forming a seat, swirl generator, and needle guide combination. This method is achieved by providing a flat disk with a first disk surface, a second disk surface, and a guide passage and plurality of flue passage opening each extending between the first disk surface and the second disk surface; forming a swirl generator in the second disk surface that communicates with the guide aperture; locating the flat disk on a first seat surface of the seat; and securing the flat disk to the seat.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

Detailed Description of the Preferred Embodiment(s)

Figure 1:
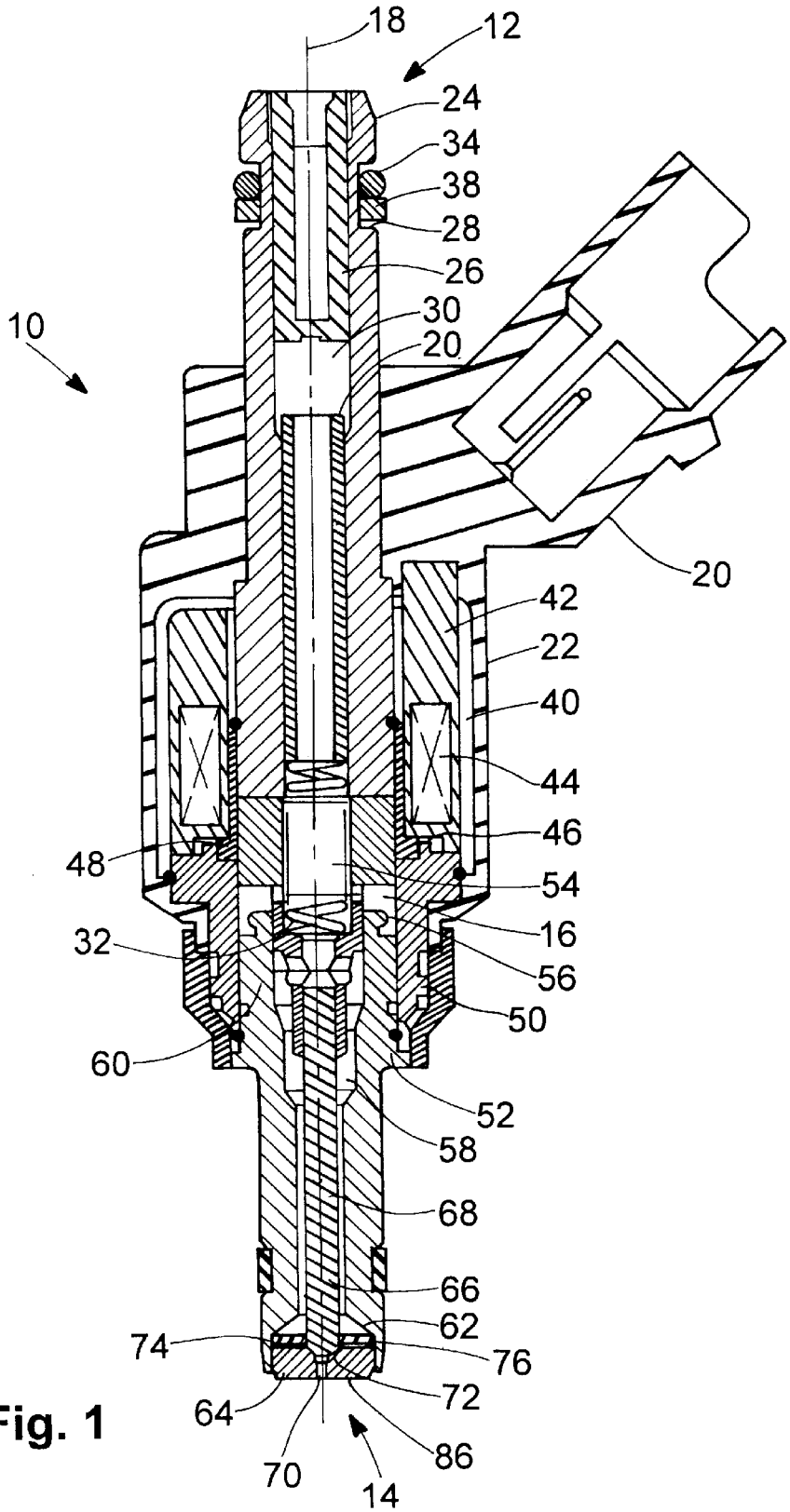
FIG. 1 is a cross-sectional view of the fuel injector of the present invention taken along its longitudinal axis.
Figure 2:
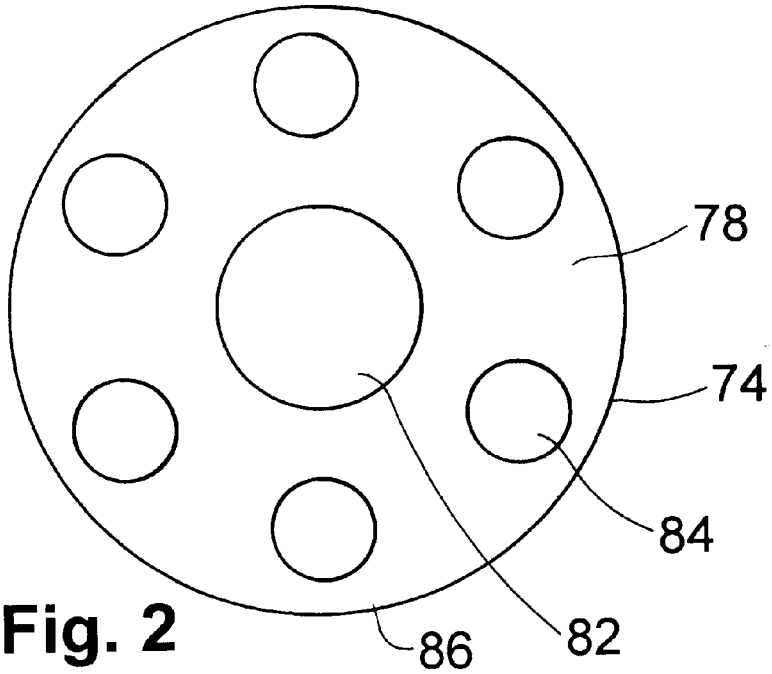
FIG. 2 is an enlarged top view of the flat disk shown in FIG. 1 that serves as the needle guide and swirl generator.
Figure 3:
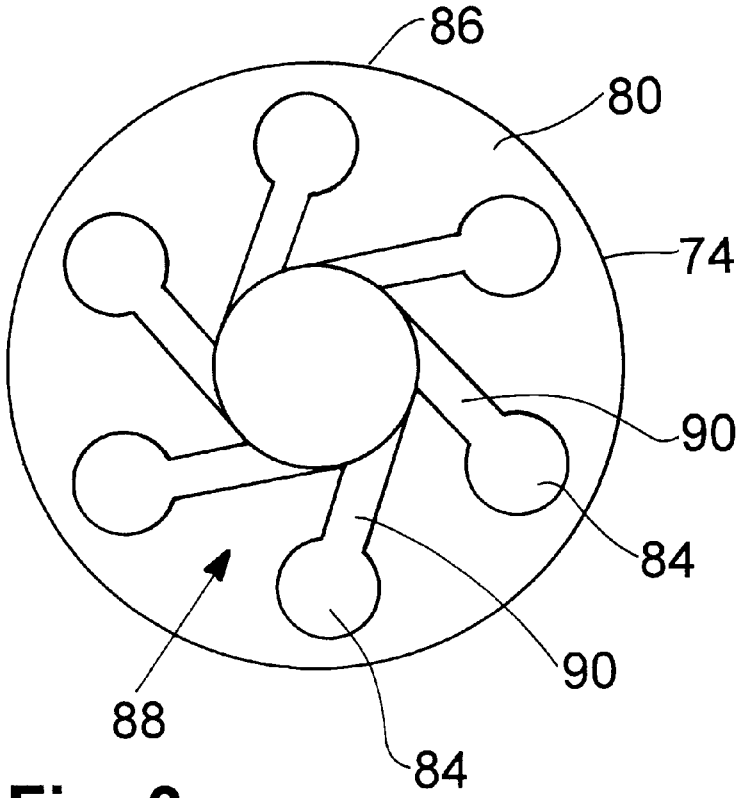
FIG. 3 is a bottom view of the flat disk shown in FIG. 1 that serves as the needle guide and swirl generator.

FIG. 1 illustrates a preferred embodiment of the fuel injector 10, in particular a high-pressure, direct-injection fuel injector 10. The fuel injector 10 has a housing, which includes a fuel inlet 12, a fuel outlet 14, and a fuel passageway 16 extending from the fuel inlet 12 to the fuel outlet 14 along a longitudinal axis 18. The housing includes an overmolded plastic member 20 cincturing a metallic support member 22.

Inlet member 24 with an inlet passage 26 is disposed within the overmolded plastic member 20. The inlet passage 26 serves as part of the fuel passageway 16 of the fuel injector 10. A fuel filter 28 and an adjustable tube 30 is provided in the inlet passage 26. The adjustable tube 30 is positionable along the longitudinal axis 18 before being secured in place to vary the length of an armature bias spring 32, which control the quantity of fluid flow within the injector. The overmolded plastic member 20 also supports a socket that receives a plug (not shown) to operatively connect the fuel injector 10 to an external source of electrical potential, such as an electronic control unit ECU (not shown). An elastromeric o-ring 34 is provided in a groove on an exterior extension of the inlet member 24. The o-ring 34 is biased by a flat spring 38 to sealingly secure the inlet source with a fuel supply member, such as a fuel rail (not shown).

The metallic support member 22 encloses a coil assembly 40. The coil assembly 40 includes a bobbin 42 that retains a coil 44. The ends of the coil assembly 40 are operatively connected to the socket through the overmolded plastic member 20. An armature 46 is axially aligned with the inlet member 24 by a spacer 48, a body shell 50, and a body 52. The armature 46 has an armature passage 54 aligned along the longitudinal axis 18 with the inlet passage 26 of the inlet member 24.

The spacer 48 engages the body 52, which is partially disposed within the body shell 50. An armature guide eyelet 56 is located on an inlet portion 60 of the body 52. An axially extending body passage 58 connects the inlet portion 60 of the body 52 with an outlet portion 62 of the body 52. The armature passage 54 of the armature 46 is axial aligned with the body passage 58 of the body 52 along the longitudinal axis 18. A seat 64, which is preferably a metallic material, is located at the outlet portion 62 of the body 52.

The body 52 has a neck portion 66, which is, preferably, a cylindrical annulus that surrounds a needle 68. The needle 68 is operatively connected to the armature 46, and is, preferably, a substantially cylindrical needle 68. The cylindrical needle 68 is centrally located within the cylindrical annulus. The cylindrical needle 68 is axially aligned with the longitudinal axis 18 of the fuel injector 10.

Operational performance of the fuel injector 10 is achieved by magnetically coupling the armature 46 to the inlet member 24, near the inlet portion of the body 60. A portion of the inlet member 24 proximate the armature 46 serves as part of the magnetic circuit formed with the armature 46 and coil assembly 40. The armature 46 is guided by the armature guide eyelet 56 and is responsive to an electromagnetic force generated by the coil assembly 40 for axially reciprocating the armature 46 along the longitudinal axis 18 of the fuel injector 10. The electromagnetic force is generated by current flow from the ECU through the coil assembly 40. Movement of the armature 46 also moves the operatively attached needle 68. The needle 68 engages the seat 64, which opens and closes the seat passage 70 of the seat 64 to permit or inhibit, respectively, fuel from exiting the outlet of the fuel injector 10. The needle 68 includes a curved surface 72, which is preferably a spherical surface, that mates with a conical end of a funnel that serves as the preferred seat passage 70 of the seat 64. Further detailed description of the interaction of the curved surface of the needle 68 and the conical end of the funnel of the seat 64 is provided in commonly assigned U.S. Pat. No. 5,875,972, which is expressly incorporated herein in its entirety by reference. During operation, fuel flows in fluid communication from the fuel inlet 12 source (not shown) through the inlet passage 26 of the inlet member 24, the armature passage 54 of the armature 46, the body passage 58 of the body 52, and the seat passage 70 of the seat 64 to be injected from the outlet of the fuel injector 10.

A flat disk 74 is located proximate the first seat surface 76 of the seat 64. The flat disk 74 includes a first disk surface 78, a second disk surface 80, a guide aperture 82, and at least one fuel passage opening 84 extending between the first disk surface 78 and the second disk surface 80. The first disk surface 78 and second disk surface 80 engage an outer circumference, which is, preferably, circular. A swirl generator 88 formed in the second disk surface 80 that communicates with the at least one fuel passage opening 84 and the passage 70 of the seat 64. The swirl generator 88 has at least one channel 90 that extends from the at lease one fuel passage opening 84 toward the guide aperture 82.

The at least one channel 90 extends substantial tangent to a periphery of the guide passage. The at least one channel 90 is, preferably, a plurality of channels 90 uniformly disposed about the guide aperture 82. In a preferred embodiment, six channels 90 are provided in the second disk surface 80.

The at least one fuel passage opening 84 is, preferably, a plurality of fuel passages openings 84 disposed about an axis of the guide aperture 82, one of the plurality of channels 90 corresponds to one of the plurality of fuel passage openings 84. Each of the plurality of channels 90 forms a flow passage between the corresponding fuel passage opening 84 and the guide aperture 82. The flat disk 74 is disposed on the first seat surface 76 of the seat 64 so that a fuel passing through the swirl generator 88 is directed toward the conical end of the funnel, which serves as the seat passage 70.

The flat disk 74 allows for a two component seat, swirl generator, and needle guide combination to be formed. To form the combination, the flat disk 74 has a first disk surface 78, a second disk surface 80, and a guide aperture 82 and at least one fuel opening which both extend between the first disk surface 78 and the second disk surface 80. This flat disk 74 also has a swirl generator 88 formed in the second disk surface 80 that communicates with the guide aperture 82.

In a preferred embodiment, the swirl generator 88 is formed by laser machining at least one channel 90 in the second disk surface 80 as part of the swirl generator 88. More particularly, the preferred embodiment includes a plurality of channels 90 formed in the second disk surface by laser machining. Although the preferred embodiment is formed by laser machining, other techniques, such as, photochemical etching, electrical discharge machining, precision cnc machining, and micro-milling with a microscopic bit could be employed for the swirl generator 88 in the disk surface.

The laser machining of the channels 90 that form the swirl generator 88 is, preferably, achieved by employing a copper vapor laser, however, any laser machining technique that can accomplish micro-machining could be used. The copper vapor laser is used to micro-machine the metal employed for the flat disk 74. The flat disk 74 is, preferably, 305 stainless steel, and is micro-machined by the copper vapor laser with minimal thermal distortion. A copper vapor laser capable of forming the details of the swirl generator 88 in the second disk surface is currently commercially available.

After the swirl generator 88 is formed in the second disk surface 80 of the flat disk 74, the flat disk 74 is located on the first seat surface 76. Then, the flat disk 74 is secured to the first seat surface 76, preferably by laser welding, so that the swirl generator 88 formed in the second disk surface 80 communicates the fuel in the body passage 58 to the seat 64.

With the formation of an integrated swirl generator 88 in the second disk surface 80 of the flat disk 74, a guide and swirl generator 88 for the fuel injector 10 is provided by the flat disk 74. When arranged with the seat 64, the flat disk 74 and the seat 64 provide the preferred embodiment of the two component seat, swirl generator, and needle guide combination. The flat disk 74 in the preferred embodiment is a sheet metal member with a thickness of approximately 0.5 mm. The thickness of the flat disk 74 provides an axial bearing surface for the guide aperture 82 that guides the needle 68 with minimal drag.

At least one channel 90 of the swirl generator 88 is substantial tangent to a periphery of the guide aperture 82. The at least one channel 90 forms a ledge proximate a boundary of the guide aperture 82. The at least one channel 90 is, preferably, a plurality of channels 90 disposed about the boundary of the funnel. The plurality of channels 90 is uniformly disposed about the boundary of the funnel. In the preferred embodiment, there are six channels 90. Each of the channels 90 extends tangentially from an area in the second disk surface 80 between the outer circumference 86 and the guide aperture 82 and provides a tangential fuel flow path through the swirl generator 88 to a needle 68.

Each of the channels 90 of the swirl generator 88 are formed into the second disk surface 80 so that a base portion of each of the channels 90 is at an appropriate distance from the second disk surface 80 so that fluid flows toward the funnel of the seat 64. Each of the channels 90 has a particular configuration depending on the selected fuel injector 10 application. For example, the channel 90 can have a polygon cross-section with one of the sides of the polygon serving as the base portion, or a semicircular cross-section with the apex of the semicircle positioned as the base portion. The selected cross-section can have an uniform or varied width along the length of the channel 90. For example, for a selected application, the width of the cross-section can increase as the channel 90 extends from the corresponding fuel passage opening 84 to the boundary of the guide aperture 82.

The distance of base portion of each channel 90 from the second disk surface 80 is, preferably, uniform. That is, the distance of the base portion of each channel 90 from the first surface is the same along its entire length of the channel 90. More particularly, the distance from the second disk surface 80 to the base portion is the same as the distance from the second disk surface 80 to a boundary of the guide aperture 82.

Alternatively, the base portion along the length of the channel 90 could be formed so that the distance between the second disk surface 80 varies over the length of the channel 90. With the varying distance of the base portion, the channel 90 can be sloped between the corresponding fuel passage opening 84 and the boundary of the guide aperture 82.

By having a channel 90 with uniform or sloped base portions, and uniform or varied cross-section configuration widths along the length of the channel 90, different swirl generator 88 configurations can be readily provided in the second disk surface 80 of the flat disk 74. Because the axial distance between the first disk surface 78 and the first seat surface 76 of the seat 64 is selected to a predetermined value that remains the same for each of the different swirl generator 88 configurations formed in the second disk surface 80, assembly of the preferred two component seat, swirl generator, and needle guide combination can be standardized. That is, different swirl generators 88 can be employed without changing the process for securing, particularly, by laser welding, the flat disk 74 to the valve seat 64.

While the invention has been disclosed with reference to certain preferred embodiments, numerous modifications, alterations and changes to the described embodiments are possible without departing from the sphere and scope of the invention, as defined in the appended claims and equivalents thereof. Accordingly, it is intended that the invention not be limited to the described embodiments, but that it have the full scope defined by the language of the following claims.

I claim:

1. A method of forming a seat, swirl generator, and needle guide combination, comprising the steps of:

providing a single flat disk with a first disk surface, a second disk surface, and a needle guide aperture and at least one fuel opening extending between the first disk surface and the second disk surface;

forming a swirl generator in the second disk surface that communicates with the needle guide aperture;

locating the single flat disk on a first seat surface of the seat; and securing the single flat disk to the seat.

2. The method of claim 1, further comprising the step of forming the swirl generator by laser machining at least one channel in the second disk surface.

3. The method of claim 1, further comprising the step of forming the swirl generator by laser machining at least one channel in the second disk surface.

4. A fuel injector comprising:

a body having an inlet portion, an outlet portion, and a body passage extending from the inlet portion to the outlet portion along a longitudinal axis;

an armature proximate the inlet portion of the body;

a needle operatively connected to the armature;

a seat proximate the outlet portion of the body, the seat including a first seat surface, a second seat surface, a seat passage extending between the first seat surface and the second seat surface in the direction of the longitudinal axis;

a single flat disk proximate the first seat surface of the seat, the flat disk including a first disk surface, a second disk surface, a guide aperture extending between the first disk surface and the second disk surface, at least one fuel passage opening extending between the first disk surface and the second disk surface, and a swirl generator formed in the second disk surface that communicates with the at least one fuel opening and the passage of the seat.

5. The fuel injector of claim 4, wherein the swirl generator comprises at least one channel that extends from the at least one fuel passage opening toward the guide aperture.

6. The fuel injector of claim 4, wherein the at least one channel extends substantially tangent to a periphery of the guide passage.

7. The fuel injector of claim 6, wherein the at least one channel comprises a plurality of channels uniformly disposed about the guide aperture.

8. The fuel injector of claim 7, wherein the at least one fuel passage comprises a plurality of fuel passages disposed about a central axis of the guide aperture.

9. The fuel injector of claim 8, wherein the flat disk further comprises a substantially circular circumferential surface engaging the first disk surface and the second disk surface; and wherein the plurality of fuel passages are located between the axis of the guide aperture and the circumferential surface of the flat disk.

10. The fuel injector of claim 9, wherein the at least one channel comprises a plurality of channels, one of the plurality of channels corresponds to one of the plurality of fuel passage openings, each of the plurality of channels forming a flow passage between the corresponding fuel passage opening and the guide aperture.

11. The fuel injector of claim 10, wherein the passage of the seat comprises a funnel between the first seat surface and the second seat surface.

12. The fuel injector of claim 11, wherein the flat disk is disposed on the first surface of the seat so that a fuel passing through the swirl generator is directed toward a conical end of the funnel.

13. The fuel injector of claim 12, wherein the swirl generator is laser machined into the second disk surface.

14. A single flat disk for a fuel injector, the flat disk providing a guide for a needle of the fuel injector and an arrangement to swirl fuel on a seat comprising;

a first disk surface;

an outer circumference engaging the first disk surface;

a second disk surface engaging the outer circumference;

a guide aperture extending between the first disk surface and the second disk surface, the guide aperture having a central axis;

a plurality of fuel passages extending between the first disk surface and the second disk surface; and a swirl generator formed in the second disk surface that communicates with the guide aperture.

15. The flat disk of claim 14, wherein the swirl generator comprises a plurality of channels, each of the plurality of channels corresponding to one of the plurality of fuel passage openings.

16. The flat disk of claim 15, wherein each of the plurality of channels comprises a channel substantially tangent to a periphery of the guide aperture.

17. The flat disk of claim 16, wherein at least one channel is machined in the second disk surface.

* * * * *